US005319566A

United States Patent [19]

Kongho et al.

[11] Patent Number: 5,319,566

[45] Date of Patent: Jun. 7, 1994

[54] EMBROIDERING DATA PRODUCTION SYSTEM

[75] Inventors: Takeshi Kongho; Takashi Nakamura, both of Tokyo, Japan

[73] Assignee: Janome Sewing Machine Co., Ltd., Tokyo, Japan

[21] Appl. No.: 833,884

[22] Filed: Feb. 11, 1992

[30] Foreign Application Priority Data

Feb. 15, 1991 [JP] Japan ..... 3-042293
Feb. 15, 1991 [JP] Japan ..... 3-042294

[51] Int. Cl.[5] ..... G06F 15/46; D05B 19/00
[52] U.S. Cl. ..... 364/470; 112/457
[58] Field of Search ..... 364/468, 470; 112/112.11, 112.12, 457

[56] References Cited

U.S. PATENT DOCUMENTS 3,722,434 3/1973 Strother et al. ..... 112/79 A
4,475,784 10/1984 Lukawich ..... 339/43
4,646,246 2/1987 Kinoshita et al. ..... 364/470
4,660,484 4/1987 Yasui ..... 112/457
4,703,432 10/1987 Müller ..... 364/470
4,720,795 1/1988 Kinoshita et al. ..... 364/470
4,807,143 2/1989 Matsuura ..... 364/468
4,905,159 2/1990 Loriot ..... 364/470
4,991,524 2/1991 Ozaki ..... 112/121.12
5,009,176 4/1991 Shigeta et al. ..... 112/121.12
5,021,965 6/1991 Olbrich ..... 364/470

*Primary Examiner*—Long T. Nguyen
*Assistant Examiner*—Paul Gordon
*Attorney, Agent, or Firm*—Westman, Champlin & Kelly

[57] ABSTRACT

The present invention is an embroidering data production system for reading image data from an original image pattern by means of an image input device and producing embroidering data from the image data, and characterized by comprising an image reader for optically reading the original image pattern to convert it to image data of electrical signals, image data storage means for storing said image data, data processing means for processing said image data, embroidering data conversion means for converting the processed image data to embroidering data, and a RAM card for storing the converted embroidering data. Also, incorporated into the embroidering data conversion means of the embroidering data production system is means for allowing crossover lines occurring between image blocks after the sewing to easily be cut off or to be made unnoticeable, thereby enabling the production of sewing data which causes no degradation in the embroidery pattern quality.

3 Claims, 18 Drawing Sheets

EMBROIDERING DATA PRODUCTION SYSTEM

BACKGROUND OF THE INVENTION

1. Field of the Invention

The present invention is related to an embroidering data production system, and particularly to an embroidering data production system suitable for use with an embroidering machine wherein embroidering data is produced from an original image pattern of any design, characters, etc. which is input by image input device.

2. Description of the Prior Art

A data memory device has been disclosed, for instance, in U.S. Pat. No. 3,722,434. in which a replica of a desired pattern is optically read by a scanner and then converted to electrical signals, which are input to a data recorder and stored in a punch card.

In addition, a technique is disclosed, for instance, in U.S. Pat. No. 4,475,784, in which external memory means is mounted on the data read section of the sewing machine main body and used as an auxiliary memory means of the machine.

In the above-mentioned data memory device, black and white data read by a scanner is converted to electrical signals of 1 and 0 which are only stored in a punch card, and thus such sewing data of a predetermined pitch as required for the current embroidering machine cannot be obtained.

SUMMARY OF THE INVENTION

It is an primary object of the present invention to provide an embroidering data production system using an image input device such as an image scanner, by which sewing data of a predetermined pitch such as required by the current embroidering machine can be obtained.

Further, it is a secondary object of the present invention to provide an embroidering data production system which allows crossover lines occurring between image blocks after the sewing to easily be cut off or to be inconpicuous, thereby for producing sewing data which does not reduce the quality of embroidering patterns.

The present invention is characterized by image reader for reading an original pattern and converting it to image data of electrical signals, image data storage means for storing the image data, data processing means for processing the image data, embroidering data conversion means for converting the processed image data to embroidering data, and a random access memory (RAM) for storing the converted embroidering data.

Also the present invention is characterized in that the embroidering data conversion means includes an upper and lower end positions detecting section for detecting the upper and lower end positions of an image block in the image data storage means, an embroidering data generating section for generating embroidering data from the image data, a distance calculating and selecting section for calculating the end point-upper end distance and the end point-lower end distance from the position data of the upper and lower ends detected in the upper and lower end positions detecting section and the end position data of the image block converted in the embroidering data generating section and selecting the one of longer distance, and a jump stitch data generating section for determining the image data of the end point selected by the distance calculating and selecting section as jump stitch data.

Further, the present invention is characterized in that the embroidering data conversion means includes a near point detecting section for seeking a near point of a next image block for which embroidering data is to be next generated when the generation of the embroidering data of the image block in the image data storage means is terminated, upper and lower end positions detecting section for detecting the upper and lower end positions of the next image block a hidden line data generating section for generating stitch data between the near point and either of the upper or lower end position which is shorter in distance.

DETAILED DESCRIPTION OF THE PREFERRED EMBODIMENT

Figure 1:
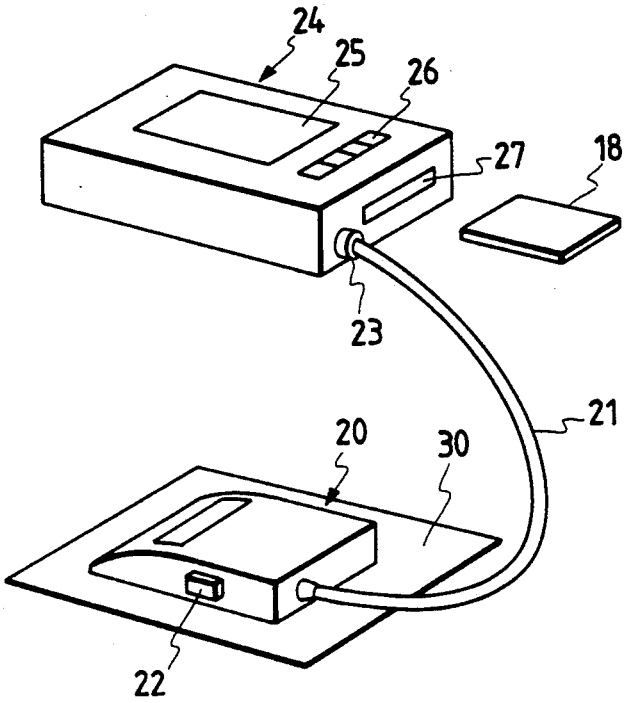
FIG. 1 shows a perspective view of an example of the embroidering data production system of the present invention.

Now, the present invention is described with reference to the drawing.

FIG. 1 is a perspective view of an example of the embroidering data production system of the present invention. In the figure, 20 represents an image input device, and an image scanner is used by way of example. Read start button 22 is provided on a side of the image scanner. The image scanner is connected to sewing data production device 24 by dedicated cable 21 and plug 23.

Sewing data production device 24 includes opera-&ion key section 26 for setting the device 24 to an image scanner input mode, and display section 25 for providing display associated with the image processing of original image data to be described later, and on a side of the device 24, there are provided a plug receptacle and card write section 27 in which RAM card 18 as an external storage medium is set for writing produced sewing data.

Although not shown, the sewing data production device 24 has contained therein a read only memory (ROM) in which an image processing program or the like is stored, a random access memory (RAM) provided with an VRAM region for storing original image data during the image processing and various regions such as work area for temporarily storing data and the like during the image processing, and a central processing nit (CPU) for comprehensively controlling them.

The image scanner used in this embodiment has an effective read width of 63 mm, a binary tone output of black and white, and 504 main scan effective picture elements. 30 represents a sheet with white ground on which an original image to be read in by the image scanner is drawn.

Figure 2:
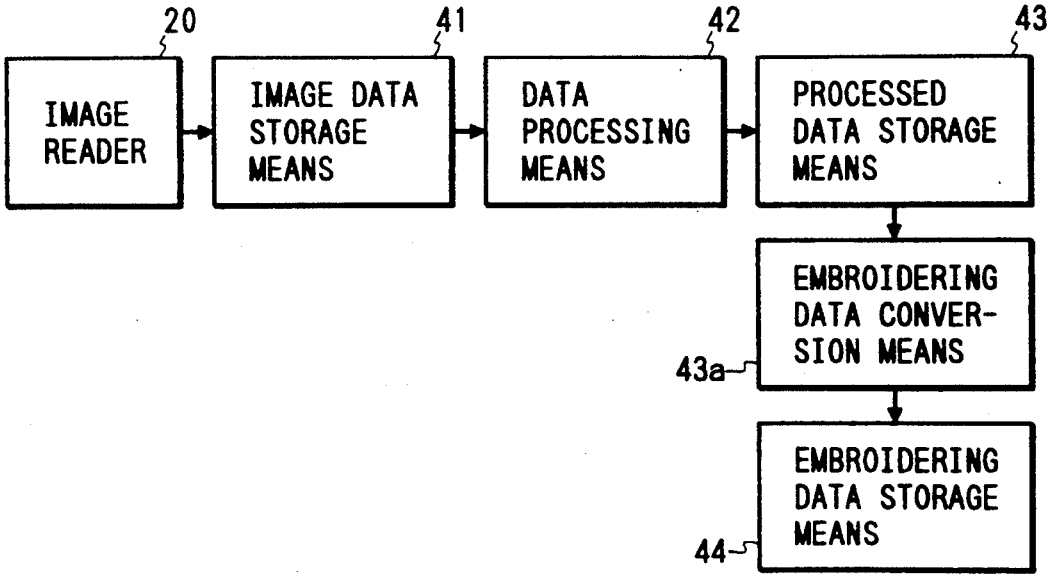
FIG. 2 is a block diagram outlining the configuration of the embroidering data production system.

FIG. 2 is a block diagram showing the general configuration of the embroidering data production system. The original image data read from image reader 20 is temporarily stored in image data storage device 41 in sewing data production device 24 through the dedicated cable 21. The data stored in the image data storage device 41 is subjected to data processings such as noise removal, compression, etc. in data processing unit 42. The original image data having experienced such data processings is temporarily stored in processed data storage means 43. Thereafter, the image data is converted by embroidering data conversion means 43*a* to embroidery sewing data and stored in RAM card 18 loaded in the card write section 27, or embroidering data storage means 44.

Figure 3:
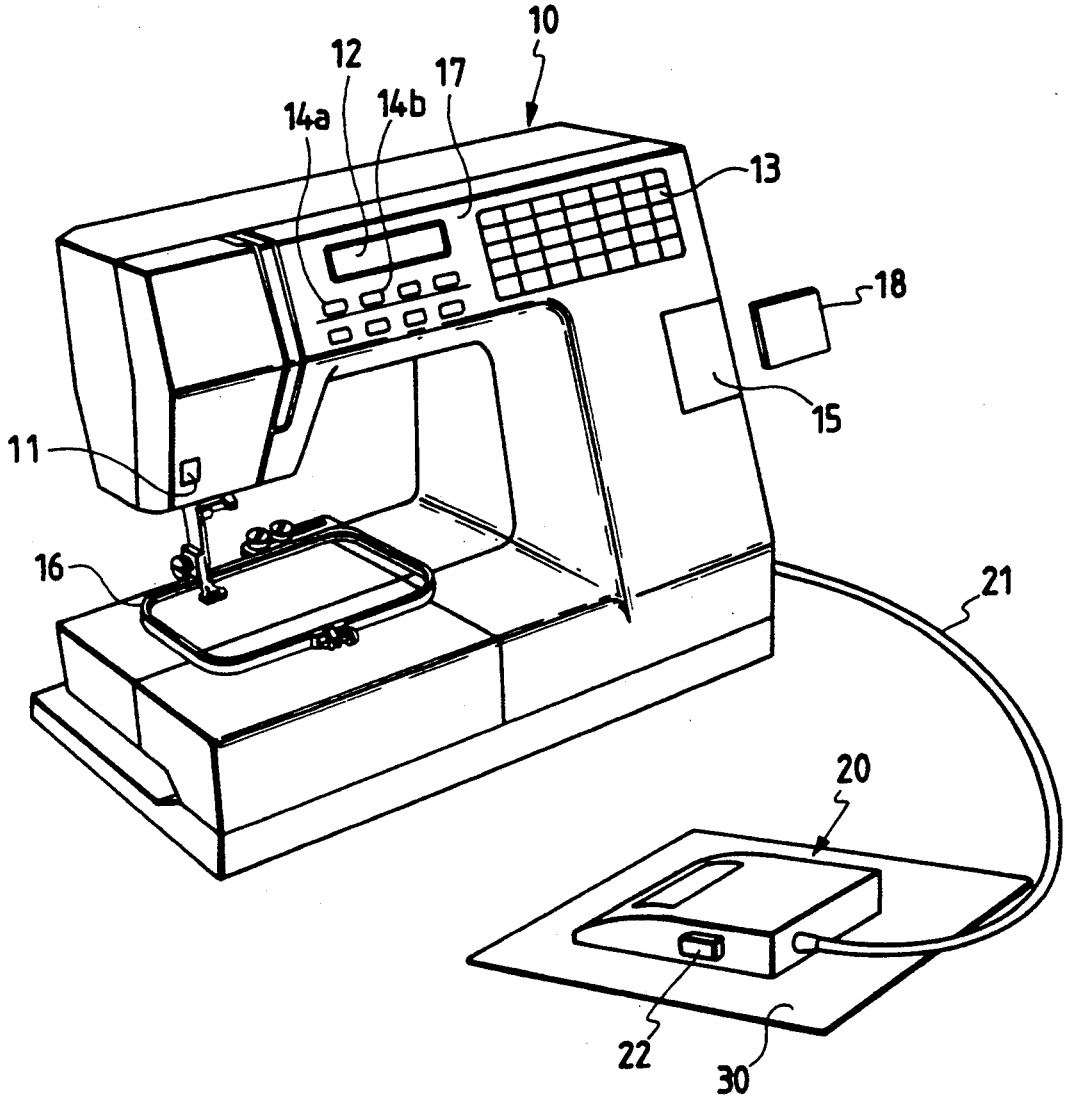
FIG. 3 is a perspective view of an embroidering machine incorporating a sewing data production device, and an image input device.

Another example of the embroidering data production system of the present invention is described below. In this example, the sewing data production device 24 is incorporated into an embroidering machine. FIG. 3 shows the external appearance of the embroidering machine and image input device 20 connected thereto.

In the figure, 10 represents an embroidering machine which enables a pattern sewing by a standard needle and cloth feed, and an embroidery sewing in which an embroidery frame is driven, and on the front panel 17 of embroidering machine 10, there are provided start/stop key 11 for starting and stopping the machine, liquid crystal display 12, pattern selecting section 13, operation key section 14, and card reader/writer section 15 for reading/writing data from/to RAM card 18.

The operation key section 14 includes image scanner input mode key 14*a*, embroidering data conversion key 14*b* for instructing conversion of the original image data read in from the original image input device described later to embroidering data, etc. Further, on the liquid crystal display 12, a message for instructing the sewer on the machine operation procedure, the original image data read in from the original image input device, etc. are displayed.

16 is an embroidery frame for holding embroidery cloth, and the embroidery frame 16 is detachably fixed to a carriage which is driven by X-Y driver means, not shown, in the X-axis and Y-axis directions. The construction of the driving of the embroidery frame 16 is described in Japanese Patent Application No. 134217/1990 filed by the present applicant, and thus explanation thereof is omitted.

20 is an image scanner as an example of the original image input device, and read start button 22 is provided in a side thereof. The image scanner 20 is electrically and mechanically connected to embroidering machine 10 via dedicated cable 21 and a plug, not shown.

30 is a sheet of paper on which an original image pattern is drawn. As the sheet 30, white paper is preferably used, and on this paper, an original image pattern of characters, pictures, etc. having a line width of 1 mm or thicker is drawn with a black pen or the like.

As the image scanner 20, for instance, the one having an effective read width of 63 mm, binary tone output of black and white, and 504 main scan effective picture elements can be used.

The outline of the hardware configuration of the embroidering machine 10 is now described with reference to the block diagram of FIG. 4. Incidentally, those same as or identical to FIG. 3 are represented by the same symbols with or without a subscript.

In the figure, 40 is a central processing unit for controlling the overall operation of the embroidering machine. 41 is image data storage means for storing the image data read by the image reader 20. 42 is data processing means for performing the processings such as removal of noises from the stored image data in the image data storage means 41, and 43 is processed data storage means for storing the data processed in the data processing means 42.

Further, 44 is embroidering data storage means, in which embroidering data converted by central processing unit 40 from the data stored in the processing data storage means 43 is stored. The embroidering data storage means 44 corresponds to RAM card 18 mounted on the card reader/writer section 15.

45 is internal pattern storage means, and 46 is program storage means. Stored in the program storage means 46 are image processing programs such as a program for controlling the data processing means 42 and a program for converting the data stored in the processed data storage means 43 to embroidering data, a control program for controlling the overall operation of the embroidering machine, etc.

In addition, 47 is rotational speed instructing means, which corresponds to a controller or the like that can be freely operated by the sewer. 48 is a machine motor driver circuit which operates in response to the rotational speed instructing means, and 49 is a machine motor. 50 is machine motor's rotational speed detecting means for detecting the rotational speed of the machine motor 49. 51 is upper shaft's rotational phase detecting means for detecting the rotational phase of the upper shaft of the machine.

52 is a stepping motor driver circuit for driving the embroidery frame having cloth spread on, 53 is an X-axis driving stepping motor which is driven by the driver circuit 52, and 54 is a Y-axis driving stepping motor.

Figure 5:
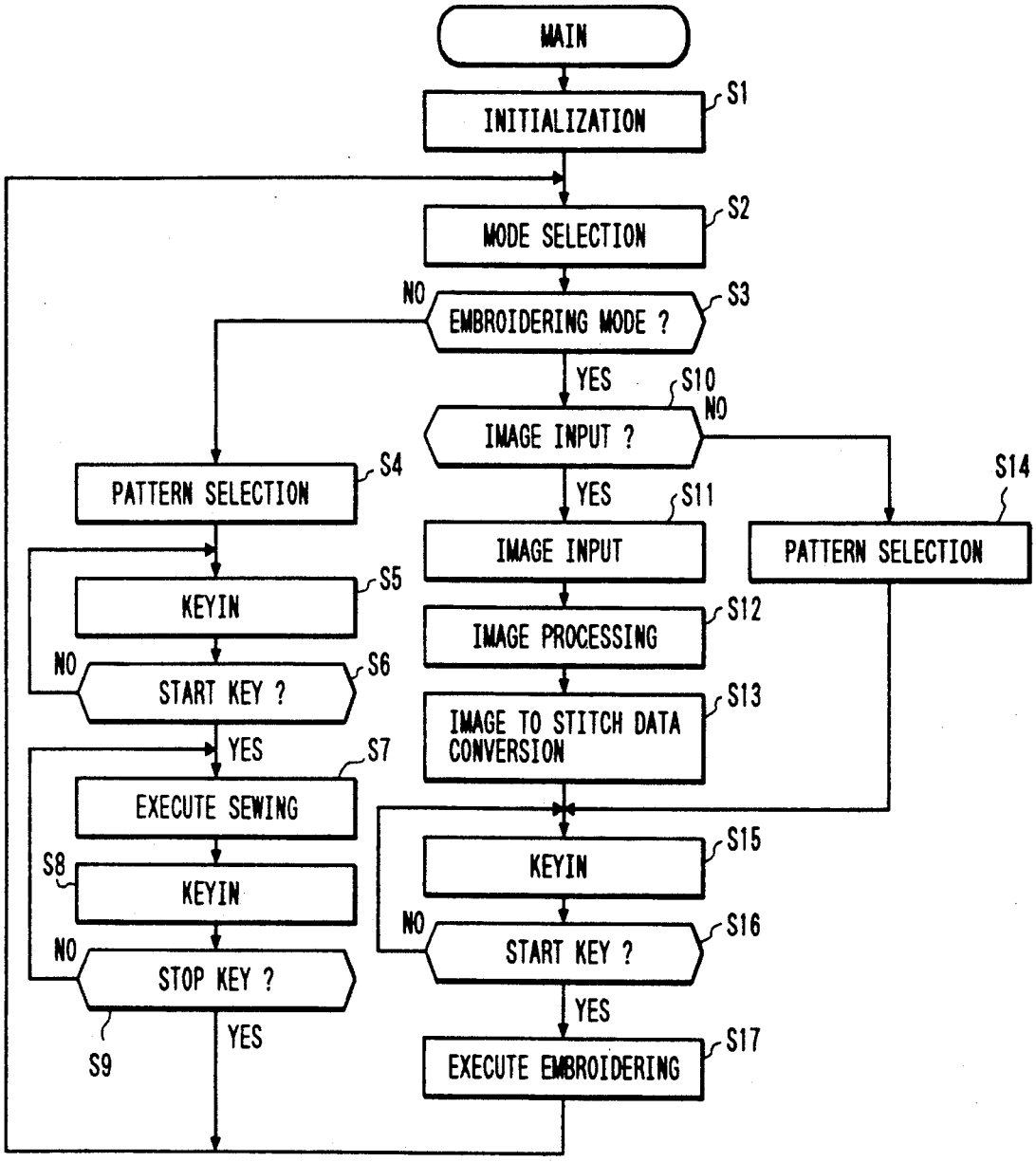
FIG. 5 is a flowchart showing the general operation of the embroidering machine incorporating the sewing data production device.

The general operation of the embroidering machine as constructed above is described below with reference to the flowchart of FIG. 5.

First, when a power supply switch, not shown, is turned on to power the embroidering machine, the machine is initialized (step S1). Then, when mode selection is made from the mode selector means in operation key section 14 (step S2) and a normal sewing made is selected (step S3 is negative). the operation goes to step S4. When, in step S4, pattern selection is performed from pattern selecting section 13, the central processing unit 40 selects sewing data for the selected pattern from the interval pattern storage means 45.

Subsequently step S5 is entered, and when the user depresses the start/stop key 11 (step S6 is positive), central processing unit 40 responds to the detection signal from the upper shaft's rotational phase detector means 51 to read out sewing data from the internal pattern storage means 45 and supply it to the stepping motor driver circuit 52. Stepping motor driver circuit 52 drives X-axis driving stepping motor 53 and Y-axis driving stepping motor 54 on the basis of the supplied embroidering data. The sewing in the normal sewing mode is performed as described above (step S7).

Then, if there is keying in step S8 and this key is determined to be the start/stop key 11 (step S9 is positive), the normal sewing mode is terminated.

Description is now made to the operation of reading an original image pattern from the image reader 20 and producing embroidering data.

Before turning on the power of machine 10, the RAM card is set in the card reader/writer section 15, and then the power is turned on. Whereupon, the machine is initialized as previously stated (step S1). Then, mode selection is performed from the mode selector means in the operation key section 14 (step S2), and if the embroidering mode is selected (step S3 is affirmative), determination is made as to whether it is image input or embroidery sewing (step S10).

If it is determined to be image input by the input from operation key section 14 (step S10 is affirmative), the machine enters an image scanner input mode (step S11), and a message, for instance "Please depress the read start button of the image scanner." is displayed on the liquid crystal display section 12.

Then, the sewer places the sheet on which an original pattern is drawn on a flat surface, puts image scanner 20 on the sheet, and moves the image scanner 20 from the first to the last position while depressing the read start button 22. By this operation, the original image pattern is converted to binary data, which is stored in image data storage 41 provided in the machine.

Upon termination of the above storing, the process advances to step S12, where the binary data stored in the image data storage means 41 is stripped of noises by data processing means 42 and stored in processed data storage means 43. Incidentally, the processed data storage means 43 may be the same as the image data storage means 41.

The original image data stored in the processed data storage means 43 is displayed on liquid crystal display section 12. Then, if the machine user depresses the embroidering data conversion key in the operation key 14 after confirming that the input data contains no noise and thus the original data has successfully been input from the characters or pictures displayed on liquid crystal display section 12, embroidering data is generated by the image processing program stored in the program storage means 46 and stored in embroidering data storage means 44, or the RAM card (step S13).

Thus, the original image pattern read from image reader 20 is converted to embroidering data and stored in RAM card 18.

To embroider characters or pictures stored in a RAM card in this way, the start/stop key 11 is turned on (step S16 is affirmative) by keying (step S15). Whereupon the embroidering data is read out from the RAM card, and stepping motor driver circuit 52 drives the X-axis and Y-axis driving stepping motors 53 and 54 (step S17). As a result, the embroidery frame 16 is driven in the X-axis and Y-axis directions, whereby beautiful embroidery stitches are formed on the cloth spread on the embroidery frame 16.

When the procedure flows from the step S10 to step S14, selection of an embroidering pattern is performed from the pattern selecting section 13. And, if start/stop key is turned on (step S16 is affirmative), the procedure goes to step S17 where the sewing of the embroidery pattern is executed.

If, in an embroidering machine having the construction as described above and performing the operation as described above, there is discontinuity of dots or pattern blocks separated like islands in the original image data, that is, there are plurality of image blocks, then crossover lines occur when the original image data is converted to embroidering data. The first embodiment of the present invention is to allow such crossover lines to easily be cut off after the sewing, and described below in detail.

Figure 6:
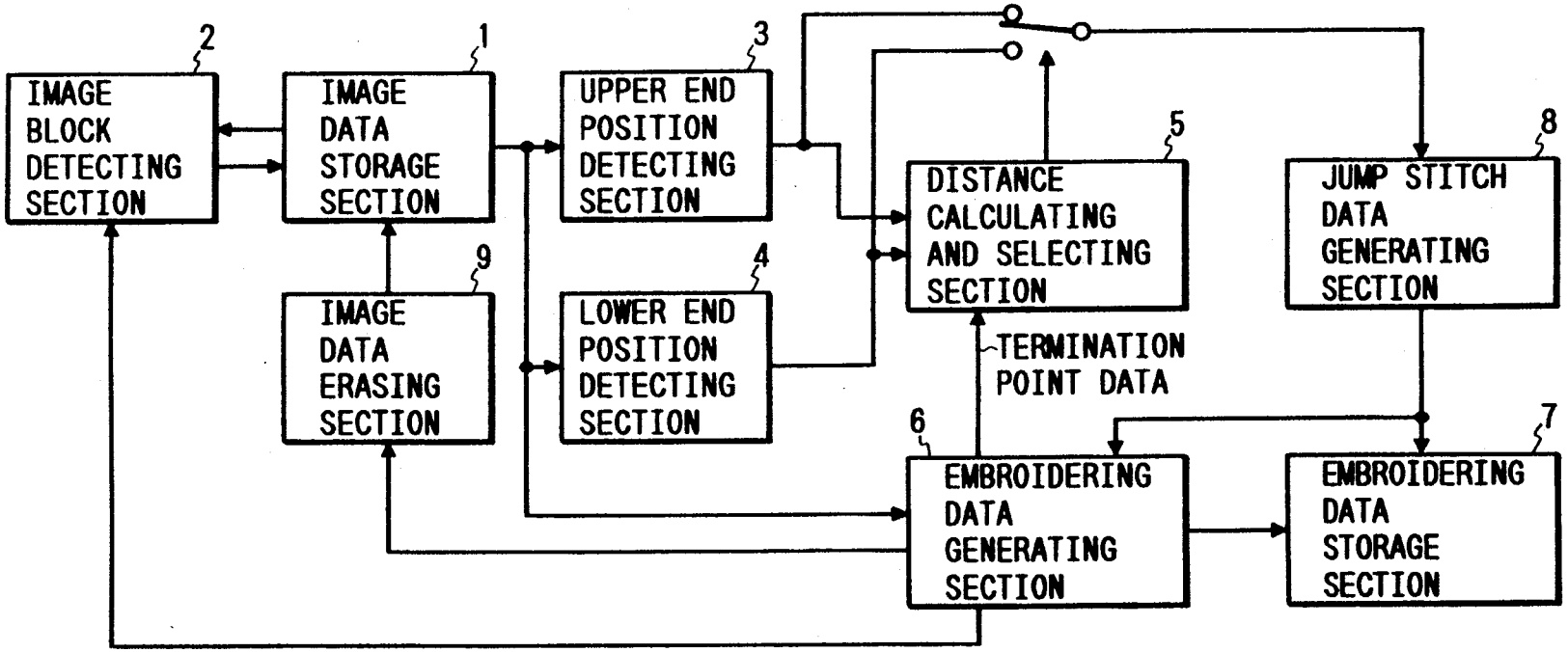
FIG. 6 is a functional block diagram of the first embodiment of the present invention.

The first embodiment of the present invention has been improved in the embroidering data conversion process of embroidering data converting means 43*a* of FIG. 2 or in the image-stitch data conversion process of step S13 in FIG. 5, and first the outline of this embodiment is described with reference to the functional block diagram of FIG. 6.

Figure 4:
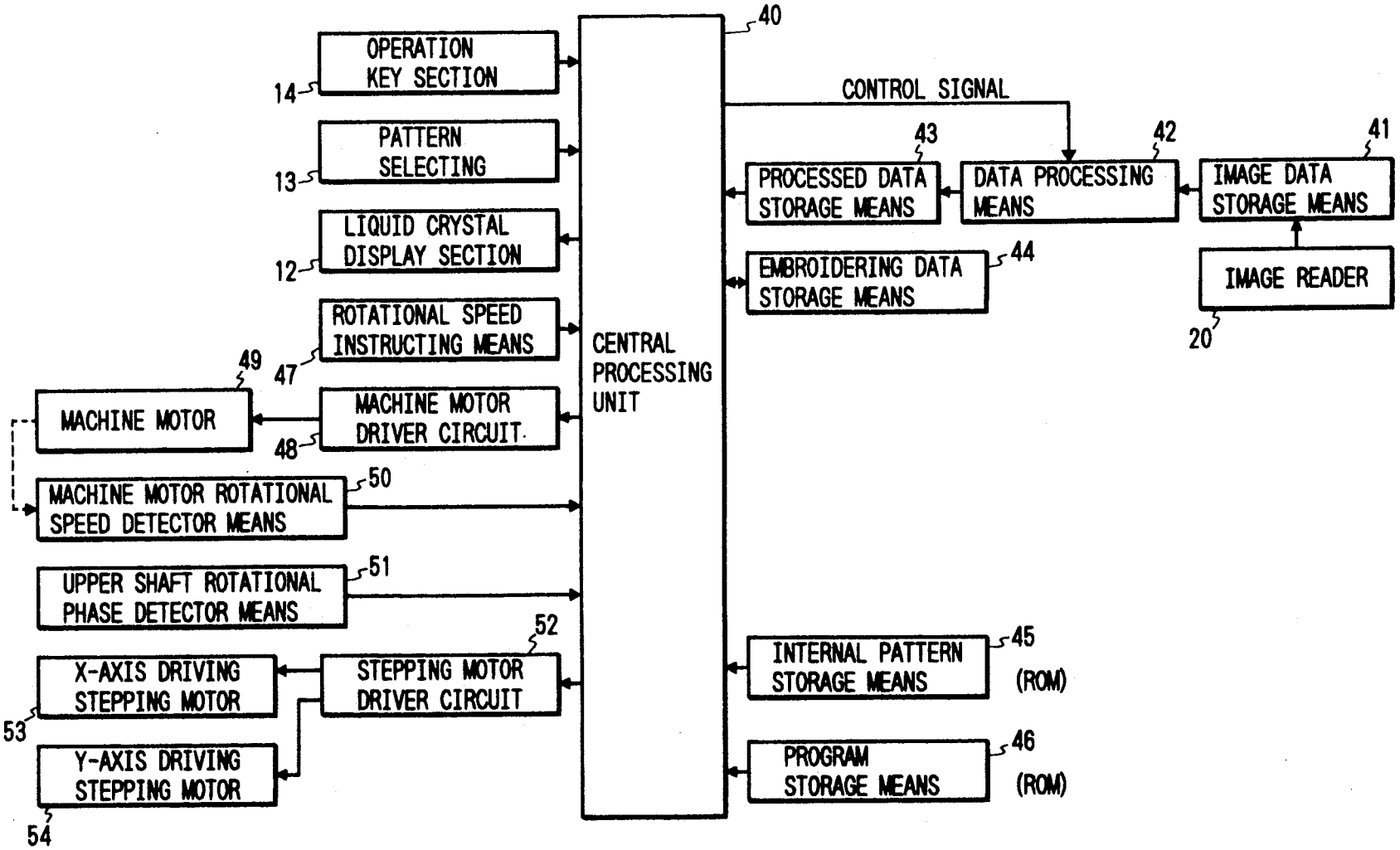
FIG. 4 is a block diagram showing the general hardware configuration of the embroidering machine.

1 is an image data storage section, which corresponds to processed data storage means 43 in FIG. 4. The image data stored in the image data storage means 1 forms one or more image blocks, and the image block to be converted to embroidering data is specified by image block detecting section 2. The specified image block is detected for the upper and lower end position data thereof by upper end position detecting section 3 and lower end position detecting section 4.

The upper and lower end position data are sent to distance calculating and selecting section 5. To distance calculating and selecting section 5, the termination point data of the image block already converted to embroidering data is input from embroidering data generating section 6. Distance calculating and selecting section 5 calculates the distance between the termination point and the upper point and the distance between the termination point and the lower point on the basis of these position data, selects the end point of longer distance, and sends the position data of this end point to jump stitch data generating section 8. Jump stitch data generating section 8 determines this position data as jump stitch data.

When jump stitch data is determined, the embroidering data generating section 6 operates to convert the image data of the image block in image data storage means 1 to embroidering data. At this time, it the jump stitch data is the upper end position data, the operation of conversion to embroidering data is performed from the upper end to the lower end. On the other hand, if the jump stitch data is the lower end position data, the operation of conversion to embroidering data is performed from the lower end to the upper end.

The embroidering data is sequentially stored in embroidering data storage section 7, and the imaged data converted to embroidering data is sequentially erased by image data erasing section 9.

Thus, in accordance with this embodiment, the distance calculating and selecting section 5 calculates the distances between the termination point of the image block converted to embroidering data and the upper and lower ends of the image block to be next converted to embroidering data, and the jump stitch data generating section 8 determines the end point of longer distance as jump stitch data, so that the crossover line caused after the embroidering becomes longer and the sewer can easily remove it.

Now, the operation of the above described present embodiment is explained in more detail with reference to FIGS. 7 and 8. For simplicity, the explanation is made by referring to FIGS. 9 to 12 as needed. It is assumed that the original image data of FIG. 9 consists of white data 61, and circular, rectangular and mountain-like image blocks 62, 63 and 64 which are painted over with black.

Figure 7:
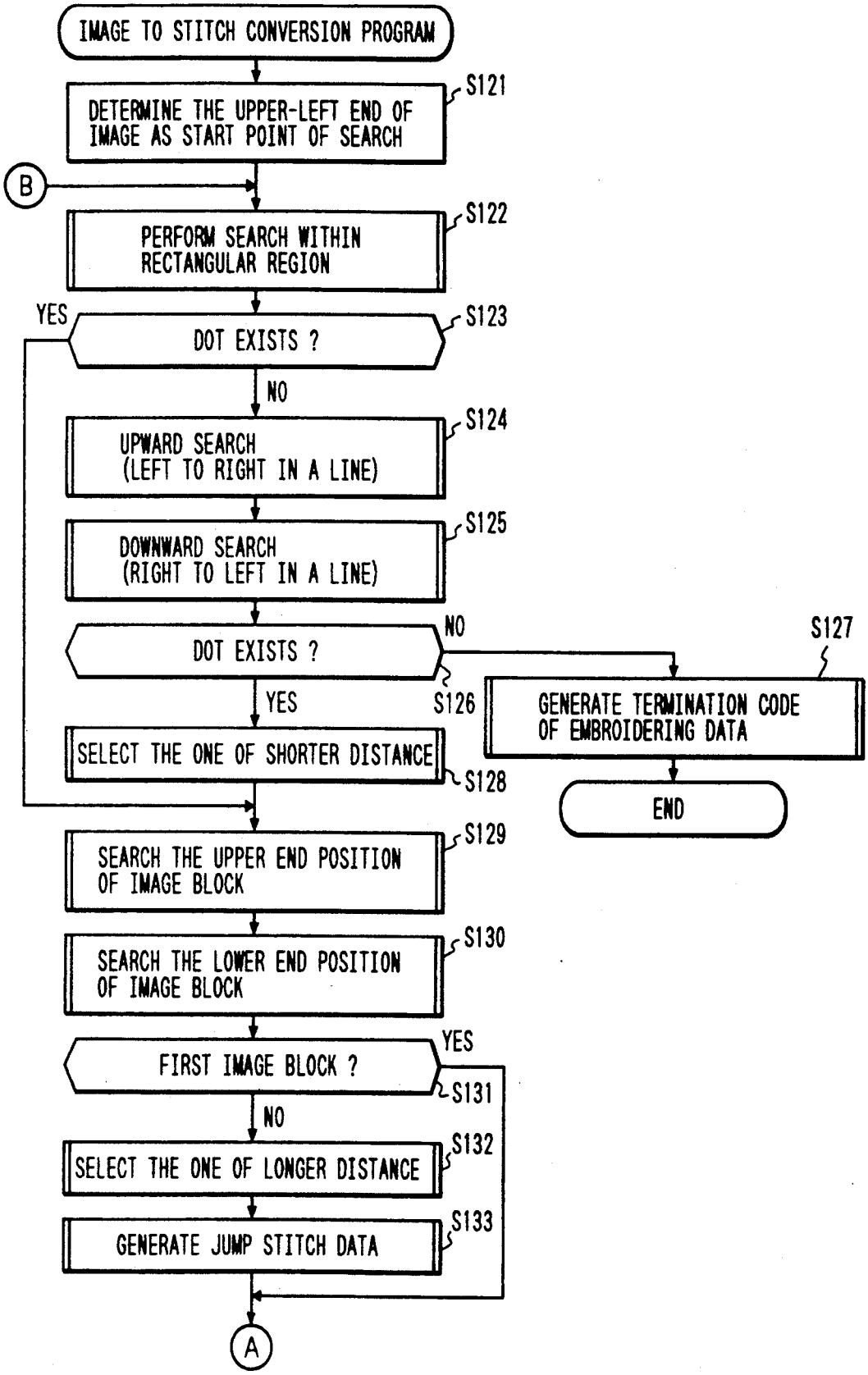
FIGS. 7 and 8 are a flowchart showing the details of step S12 in FIG. 5.

In step S121 of FIG. 7, an upper-left point (point 65 in FIG. 9) is decided to be the start point of search. In step S122, a rectangular region having the upper-left point as one vertex is searched, and it is determined whether or not a black dot exists in that region (step S123). If no dot exists (step S123 is negative), the procedure goes to steps S124 and S125 where search is made upwardly and downwardly from the upper-left point to check for the existence of a black dot (step S126). If it is determined in step S126 that no dot exists, the process flows to step S127 where the termination code of embroidering data is generated. On the other hand, if step S126 becomes affirmative, step S128 is entered to select the dot of shorter distance.

Figure 9:
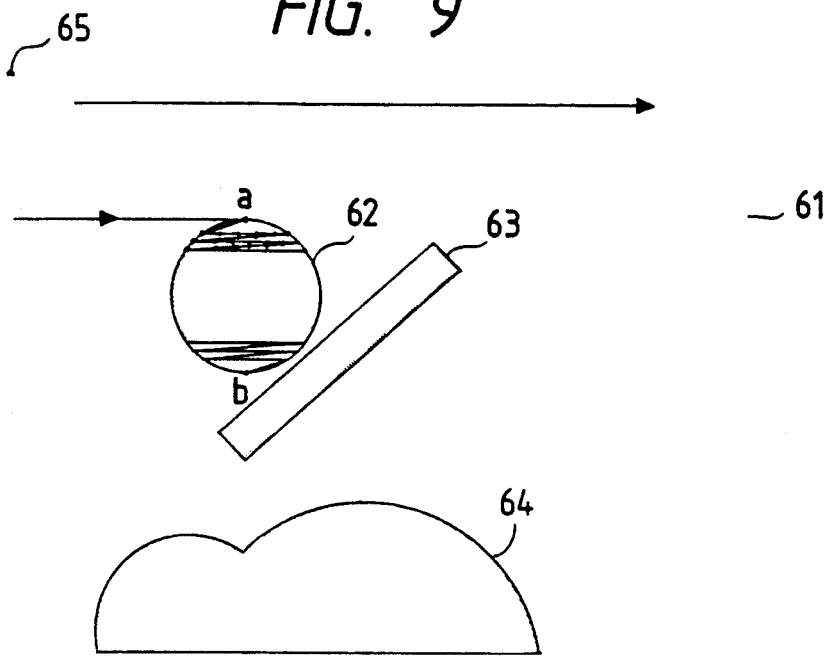
FIG. 9 is an illustration depicting a specific example of original image data converted to embroidering data.
Figure 11:
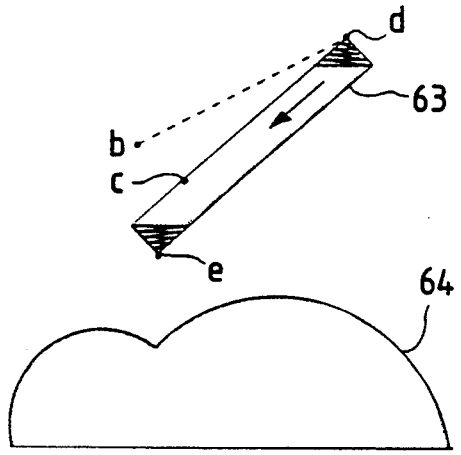
FIG. 11 is an illustration for explaining a method of converting second original block data located by the search of FIG. 10 to embroidering data.

In the example of FIG. 9, the upward search is not performed, but only the downward search is performed to obtain point a. That is, circular clock 62 is obtained. Then, the flow advances to steps S129 and S130 where the upper and lower end positions of the image block are searched.

Subsequently the determination of step S131 is performed, and the process flows to step S134 in FIG. 8 if it is affirmative. In step S134, the downward embroidering direction is selected, and the processings of steps S135 to S145 are performed. By these processings, the embroidering data from point a to point b in FIG. 9 is generated.

In step S135, stitch data is generated with a preset sewing pitch from the left end to the right end of dots. In step S136, the data of processed dot lines are deleted. In step S137, the left end of lower lines is searched to check for the existence of an image. If an image exists, the process goes to step S139 where the new left end is made effective. Then, step S140 is entered to generate stitch data directing from the right to left end.

Then, the process advances to step S141 to check whether or not unprocessed dots are remaining in the preceding lines. If unprocessed data exists, step S142 is entered and the upper lines are searched to obtain a new start point If the new start point exists at a position which is not far (step S143 is negative), the process goes to step S144 to generate jump stitch. It is determined in step S145 whether or not image data exists in the lower lines, and if the determination is affirmative, the process returns to step S135 where the above described processings are repeated.

On the other hand, if it is determined that no image exists in the lower lines, it is decided that conversion of one pattern block to embroidering data has ended, and the procedure returns to step S122.

By the above operation, conversion to embroidering data of image block 62 of circular pattern in FIG. 9 to point a is terminated. At this point, by the action of the step S136, the image data of said circular pattern image block 62 has been deleted.

Figure 10:
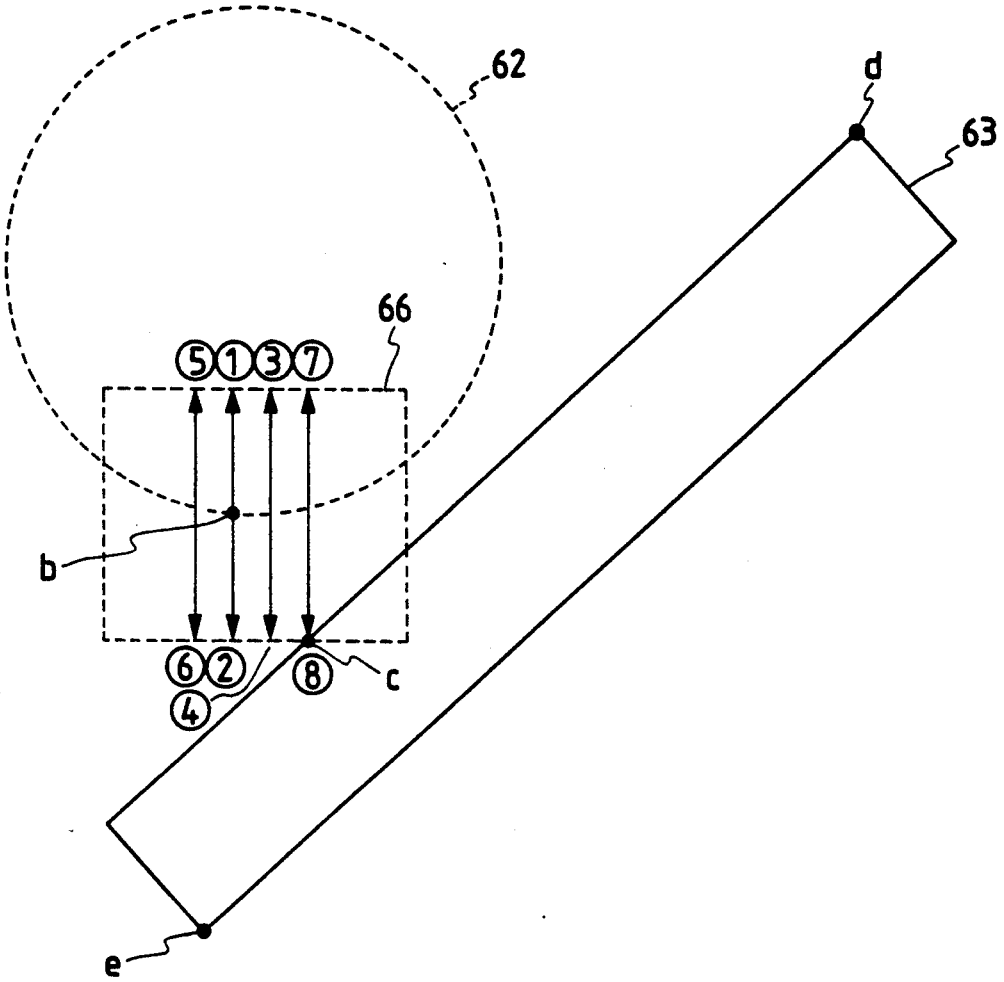
FIG. 10 is an illustration for explaining a method of searching the original image block to be next converted to embroidering data.

In step S122, search is made within a rectangular region around point b. That is, search within rectangular region 66 is performed as shown in FIG. 10. If a dot (point c) is found within the rectangular region 66 (step S123 is affirmative), the process advances to steps S129 and S130 where the upper end position d and the lowest end position e of an image block is searched. When the upper and lower end positions are found, the determination of step S131 is made.

If this determination is negative, the process goes to step S132, the main portion of this embodiment, where the end point having a longer distance between the point b is selected. And, step S133 is entered to generate jump stitch data from the point b to the end point.

According to the example of FIG. 10, since the distance from the point b to dot d, the upper end of image block 63, is greater than the distance to point e, the lower end, point d is selected in step S132. And, in step S133, jump stitch data to point d is produced.

Figure 8:
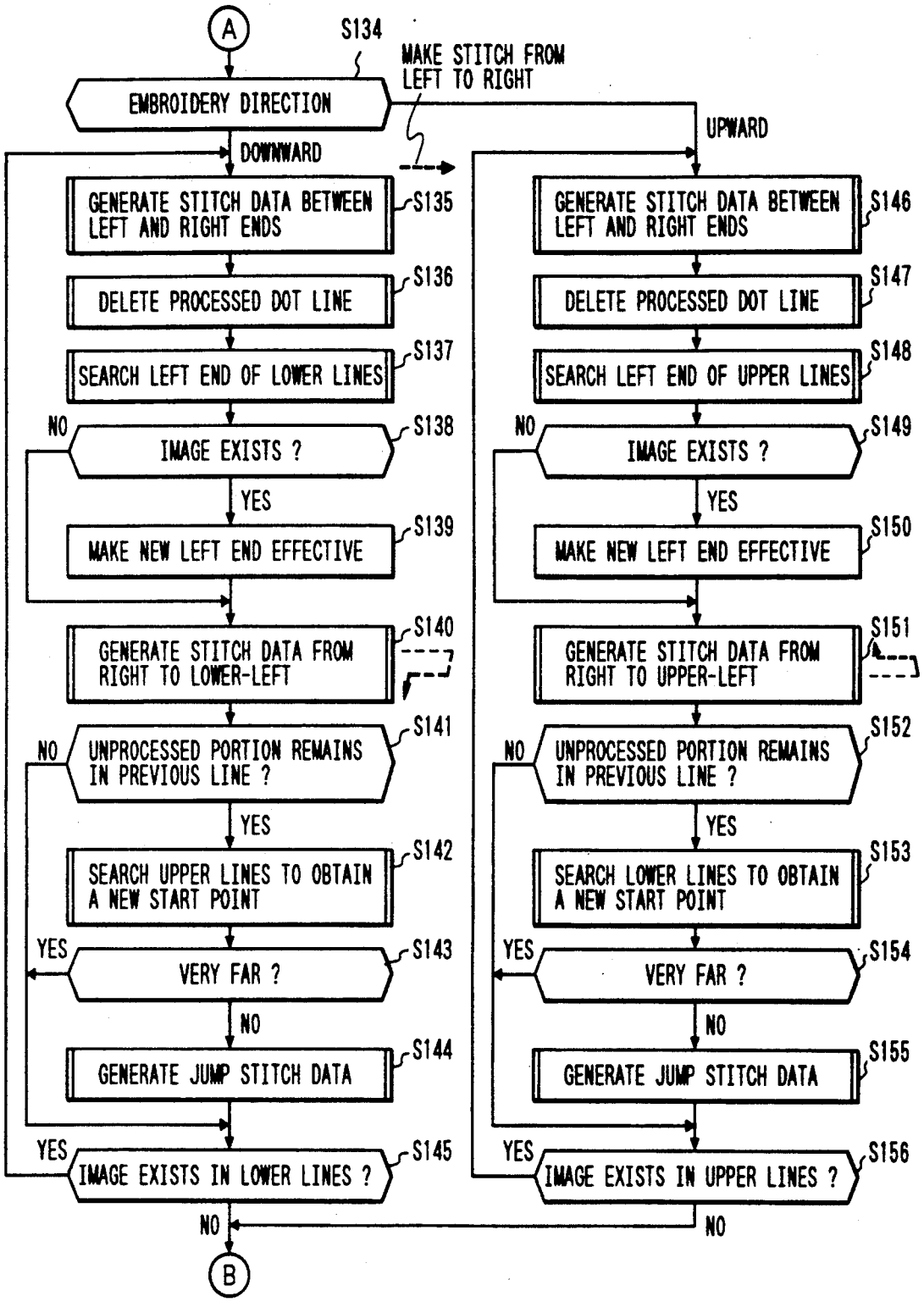

Then, the process advances to step S134 in FIG. 8 where the embroidery direction is selected. In the case of FIG. 10, the downward direction is selected, and stitch data is sequentially produced from point d by the steps S135 to S145. When the decision in step S145 becomes negative, conversion of image block 63 to embroidering data has been executed up to point e. Incidentally, if conversion to embroidering data is executed, the image data of image block 63 has been deleted.

Figure 12:
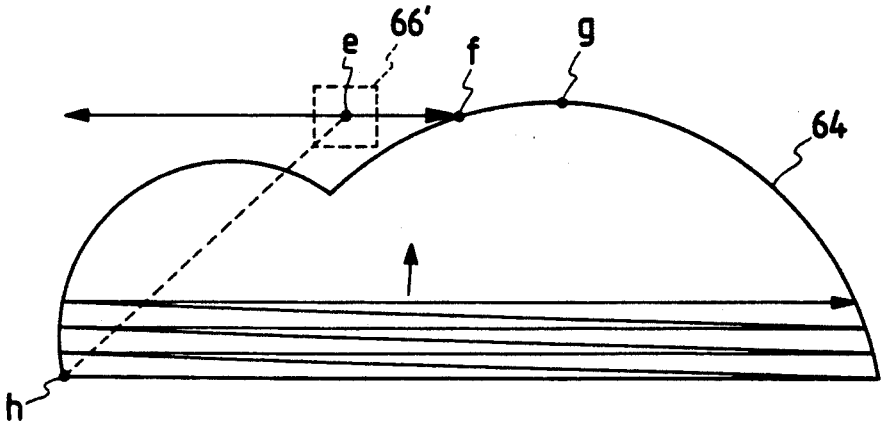
FIG. 12 is an illustration for explaining a method of converting third original block data to embroidering data.

Then, again returning to step S122, search is made in rectangular region 66 of FIG. 12 by this step. If no dot is found in this rectangular region, the process goes to steps S124 and S125 to try to find a dot. If two dots have been found by the processings of steps S124 and S125 (step S126 is affirmative), the dot having a shorter distance from point e is selected in step S128. On the other hand, if a dot is found in one of the processings of the steps S124 and S125, this dot is selected. In addition, if no dot is found, the process goes to step S127 where a termination code of embroidering data is generated.

If a dot is found at point f as in FIG. 12, the process flows to steps S129 and S130 to perform the respective processings. By the processings, the upper end position g and the lower end position h of image block 64 of a mountain-like pattern are detected.

Then, the process goes to step S132, the main portion of this embodiment, where the one having a longer distance from the point e, or point h, is selected. Subsequently step S133 is entered to generate jump stitch data toward point h.

Next, in step S134, it is determined whether the embroidery direction is downward or upward, and the upward direction is selected in the case of FIG. 12. If the upward direction is selected, the process advances from step S134 to S146. Since the operations of step S146 and the subsequent steps, or steps S146 to S156, are identical to the operations of the steps S135 to S145, the explanation thereof is omitted.

In accordance with this embodiment, since step S132 has been newly provided as described above, the crossover lines formed between the blocks can be made longer, and thus there is an effect that the sewer can easily cut off the crossover lines after the sewing.

Figure 13:
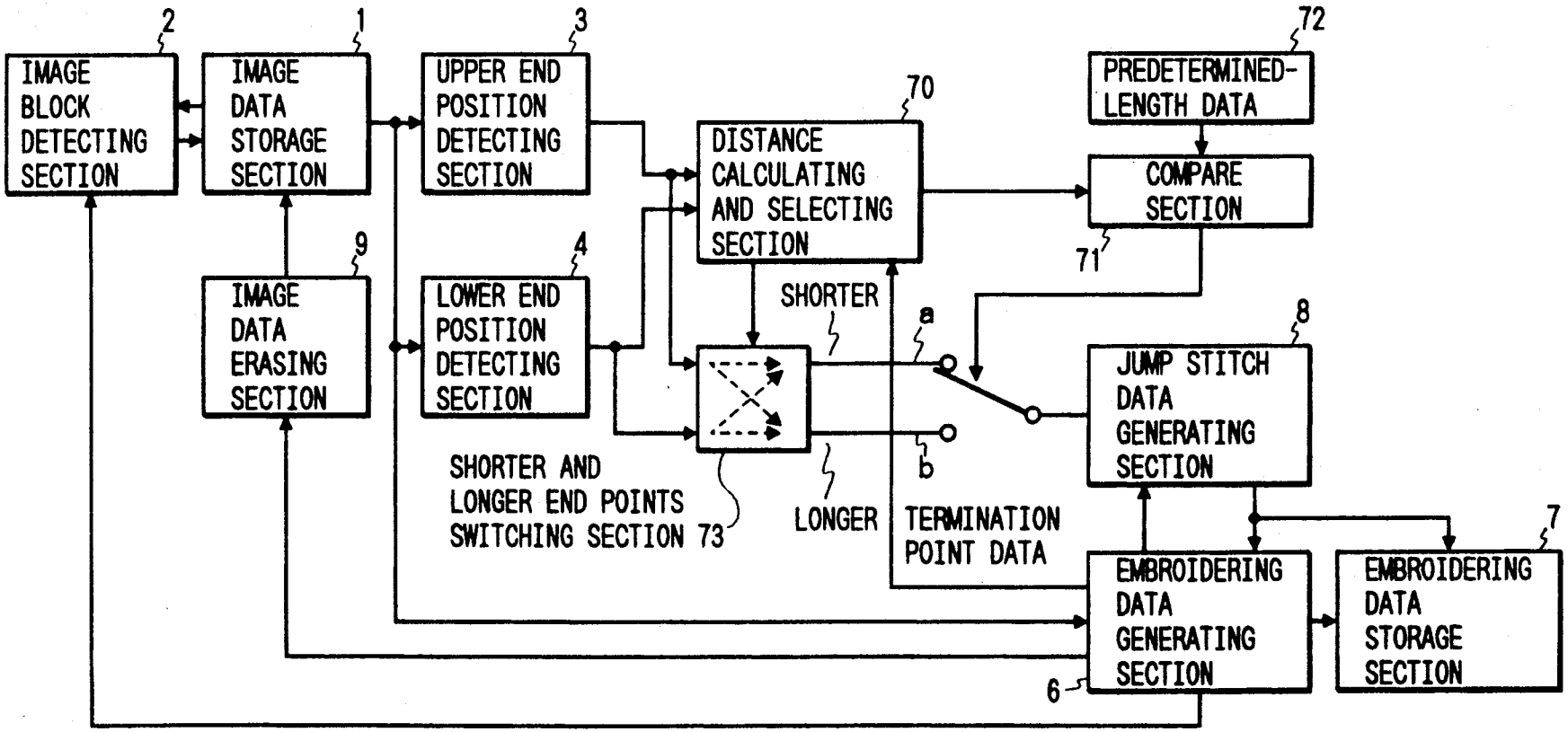
FIG. 13 is a functional block diagram of the second embodiment of the present invention.
Figure 14:
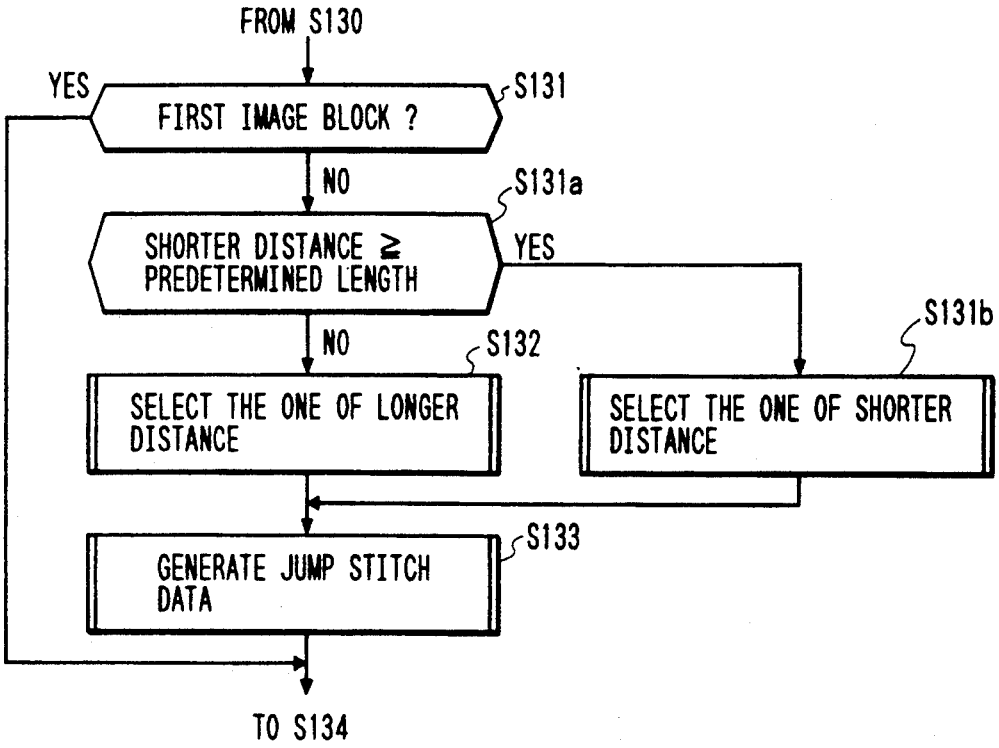
FIG. 14 is a flowchart for explaining the main portions of the second embodiment.

Now, the second embodiment of the present invention is described with reference to the functional block diagram of FIG. 13 and the flowchart of FIG. 14. FIG. 14 is the same as or identical to FIG. 7 except that steps S131*a* and S131*b* were added to steps S131 to S133 of FIG. 7.

This embodiment is characterized by the following point. The distances between the termination point of an image block completed in conversion to embroidering data and the upper and lower ends of the image block to be next converted to embroidering data ar calculated in distance calculating and selecting section 70, and the shorter distance is selected and output to compare section 71. Shorter and longer end points switching section 73 acts to connect the end point of the shorter distance to line a, and the end point of the longer distance to line b according to the result in distance calculating and selecting section 70. Compare section 71 compares the shorter distance obtained from the distance calculating and selecting section 70 with predetermined length data 72 (step S131*a*), and selects line a corresponding to the shorter distance if the former is greater (step S131*b*) and selects line b corresponding to the longer distance if the former is smaller (step S132), for connection to jump stitch data generating section 8. As a result, jump stitch data generating section 8 determines the image data of the end point of the shorter distance as jump stitch data if "shorter distance predetermined≦length", and the image data of the end point of the longer distance as jump stitch data if "shorter distance<predetermined length".

In accordance with the present embodiment, a crossover line is formed between the termination point of a block the embroidering data conversion of which has terminated and either the upper or lower end of the image block to be next converted to embroidering data which is shorter in distance, but the length of the crossover line is greater the predetermined length and thus can simply and beautifully be removed. This can contribute to improvement of the productivity as well as improvement of the embroidery pattern quality.

As obvious from the foregoing, in accordance with the first and second embodiments of the present invention, crossover lines difficult to cut off can be prevented from occurring after the sewing. As a result, crossover lines can beautifully be removed to obtain beautiful embroidery, and there is also an effect that the work by the machine user is facilitated and the productivity increases.

Figure 15:
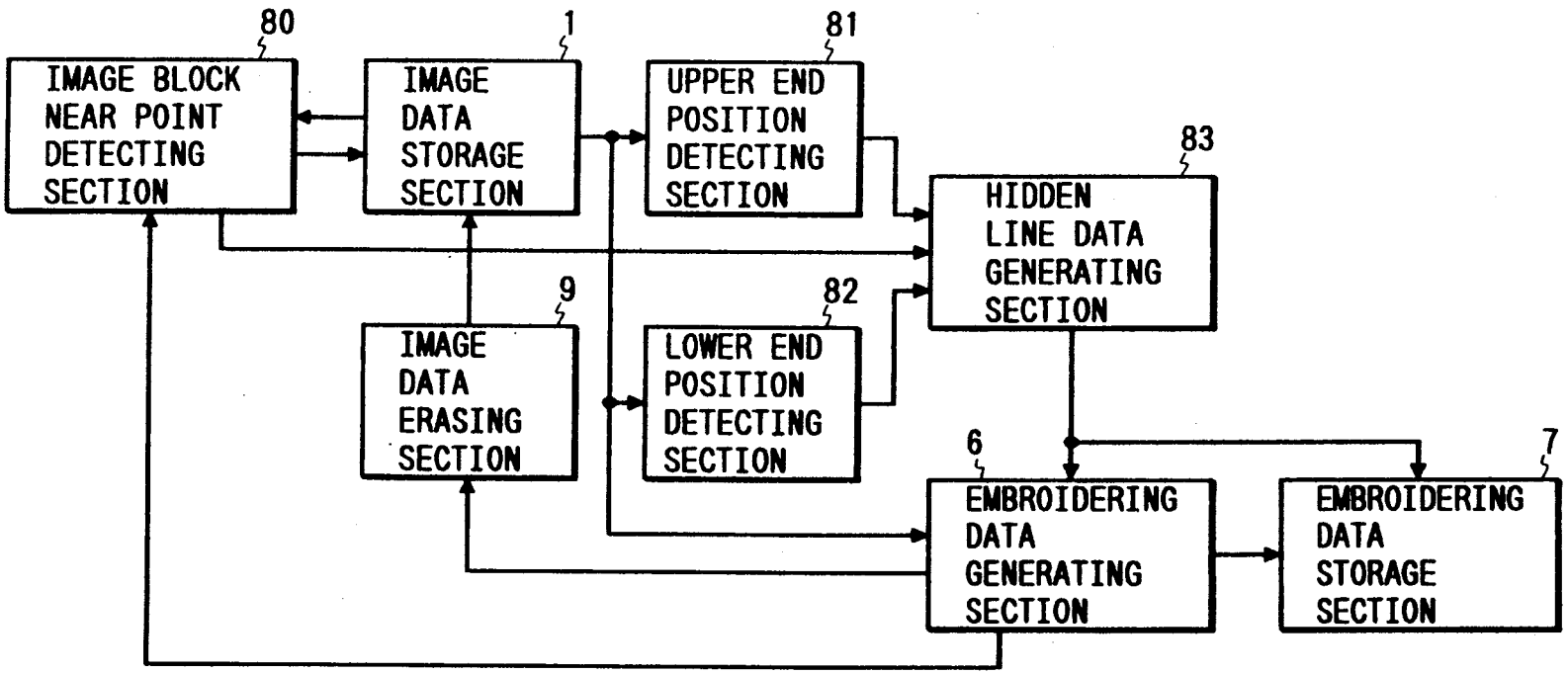
FIG. 15 is a functional block diagram of the third embodiment of the present invention.

The third embodiment of the present invention is now described. This embodiment is to make crossover lines unnoticeable. First, the outline of this embodiment is described with reference to the functional block diagram of FIG. 15.

1 is an image data storage section and corresponds to processed data storage means 43 of FIG. 4. Image data stored in the image data storage section 1 forms one or more image blocks, and the image block to be converted to embroidering data is specified by image block near point detecting section 80 and the near point thereof is detected. The upper end and lower end position data of the specified image block are detected by upper end position detecting section 81 and lower end position detecting section 82.

The position data of the near point and the position data of the upper and lower points are sent to hidden line data generating section 83. The hidden line data generating section 83 generates hidden line data between the near point and the end point which is nearer to the near point The hidden line data is formed in this embodiment so as to pass through the center of image data.

When hidden line data is generated, the embroidering data generating section 6 operates to convert the image data of the image block to embroidering data from the termination point of the hidden line. At this point, if the termination point is the upper end the operation of converting to embroidering data is performed from the upper end to the lower end. On the other hand, if the termination point is the lower end, the operation of converting to embroidering data is performed from the lower end to the upper end.

The hidden line data and embroidering data are sequentially stored in embroidering data storage section 7, and the image data converted to embroidering data is sequentially deleted by image data erasing section 9.

As described above in accordance with the present embodiment, since blocks are connected by the shortest crossover line and the crossover line in an image block is hiddenly sewed, the crossover line can be made as unnoticeable as possible.

The operation of this embodiment is now described in more detail with reference to FIGS. 16, 17 and 18. For simplicity, the description is made by referring to FIGS. 9 and 19 to 21 as needed.

Figure 16:
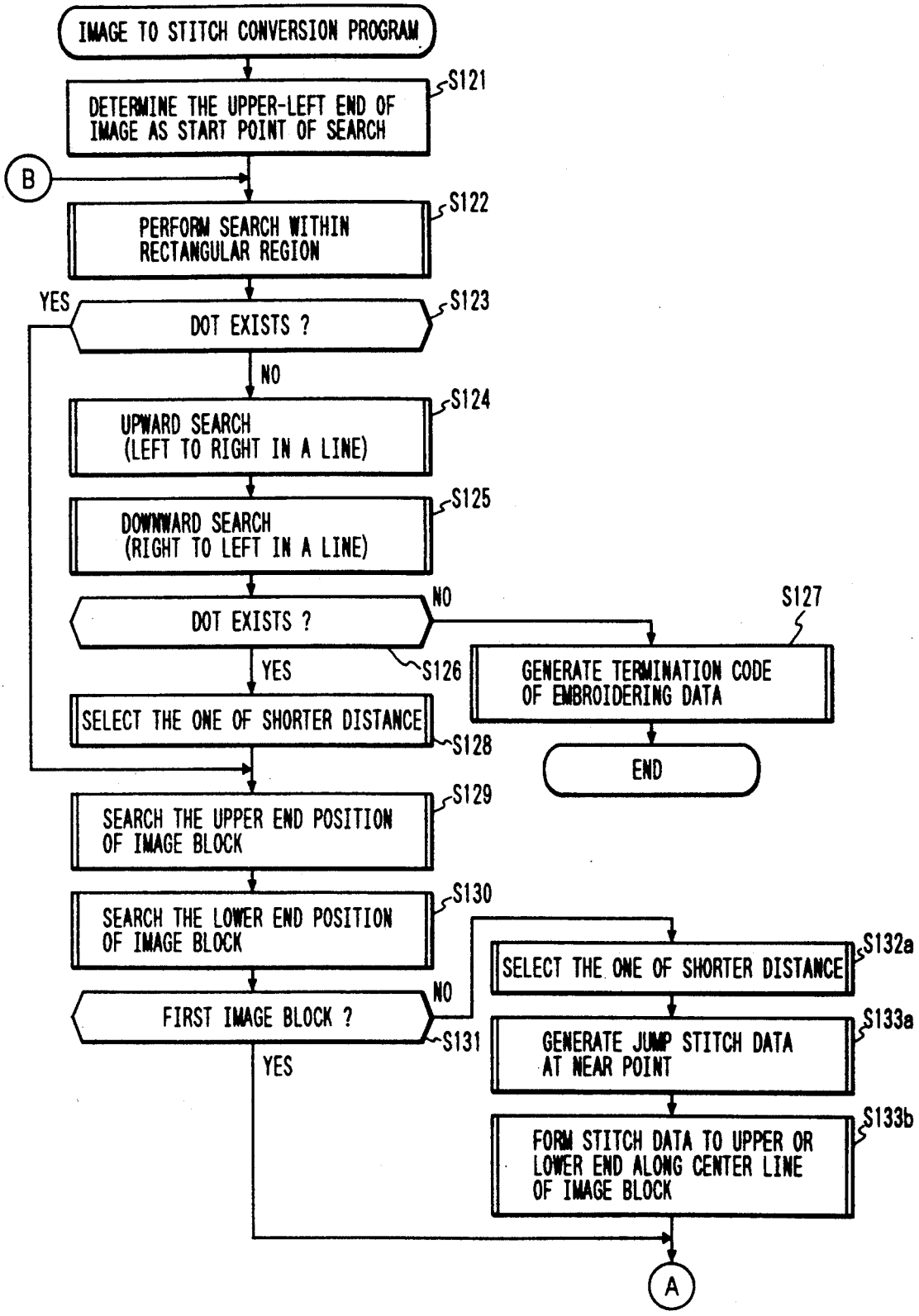
FIGS. 16 and 17 are a flowchart showing the details of step S12 in FIG. 3.
Figure 17:
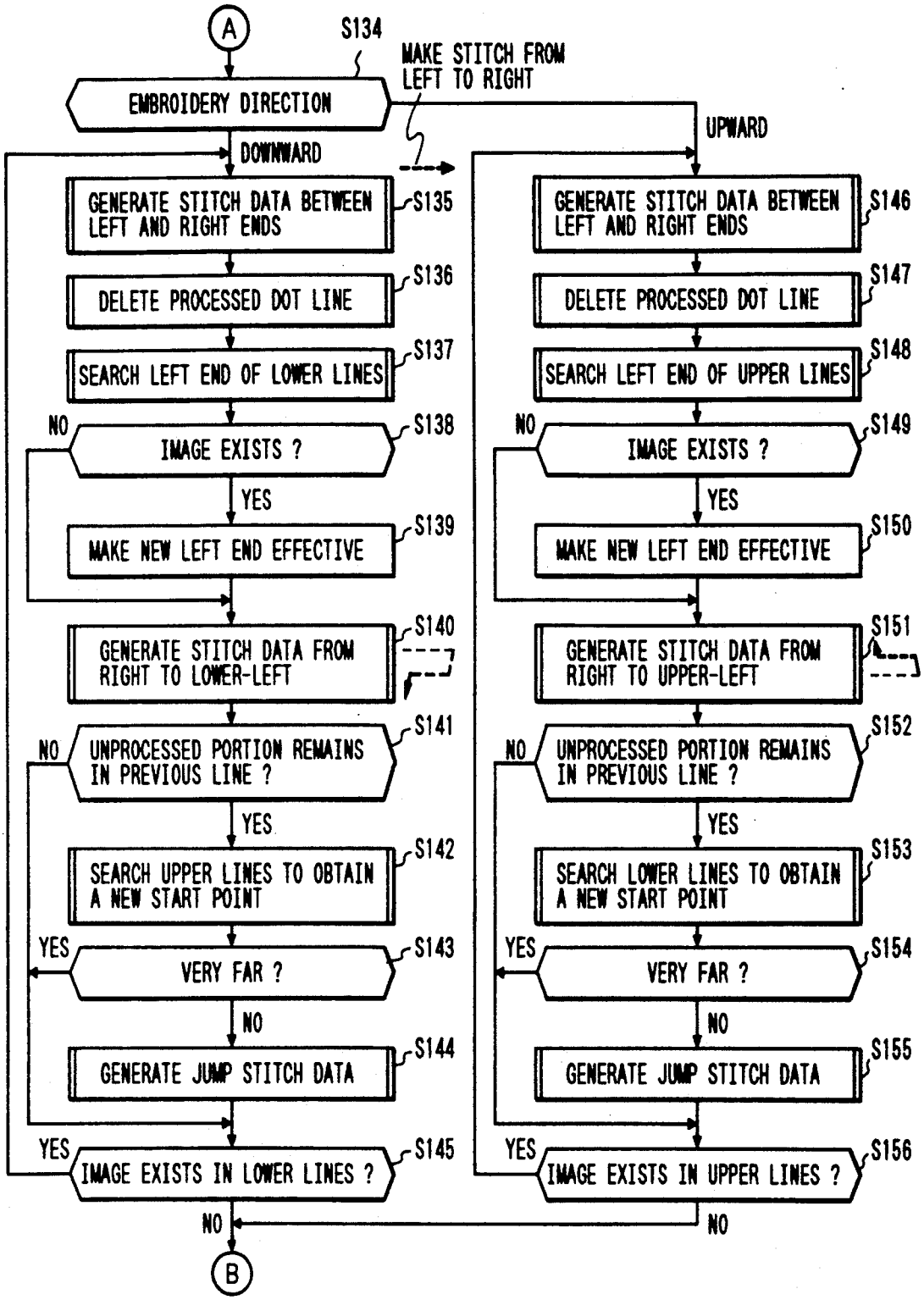
Figure 18:
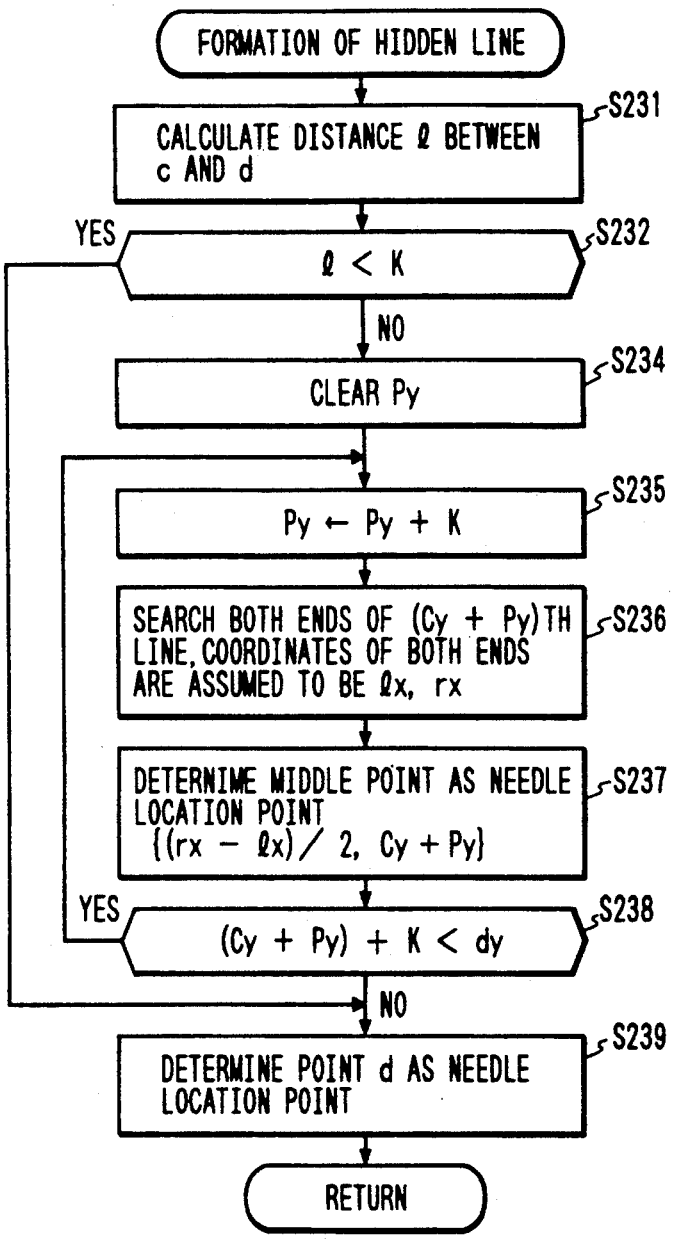
FIG. 18 is a flowchart showing a specific example of step **S133*b* in FIG. 16**.

Since steps S121 to S131 of FIG. 16 and steps S134 to S156 of FIG. 17 are the same as steps S121 to S131 of FIG. 7 and steps S134 to S156 of FIG. 8 described in the first embodiment, the explanation thereof is omitted.

If it is now assumed that the original image data read in from image input device 20 is the same data as the first embodiment, or the original data of FIG. 9, the operation of steps S121 to S131 of FIG. 16 are performed, and if the decision in step S131 is affirmative and the operations of steps S134 to S145 of FIG. 17 are performed, then conversion to embroidering data of the circular pattern image block 62 to point b is terminated. Incidentally, at this point, by the action of the step S136, the image data of the circular pattern image block 62 has been deleted. In addition, since the operation is the same as that of the first embodiment, the explanation thereof is omitted.

Figure 19:
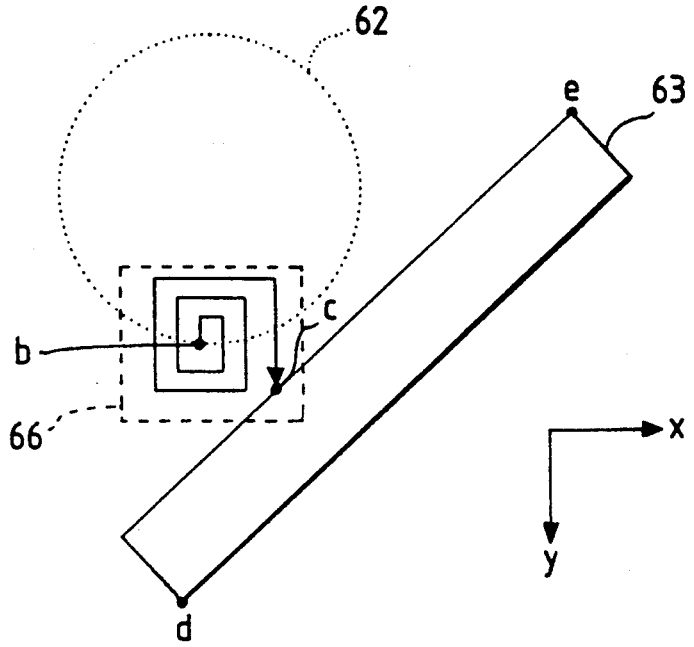
FIG. 19 is an illustration for explaining a method of searching an original image block to be next converted to embroidering data.

When conversion to embroidering data of the circular pattern image block 62 to point b is terminated, search within a rectangular region around point b, the terminal point of the image block, is performed in step S122 of FIG. 16. That is, search is spirally performed in rectangular region 66, as shown in FIG. 19.

If a dot (point c) is found in this rectangular region 66 (step S123 is affirmative), the process goes to steps S129 and S130 where the upper and lower end positions of image block 63 are searched. The point c is the dot of those of the image block to be next converted to embroidering data which is near to termination point b of the previous image block. Accordingly, the point c is hereinafter referred to as near point.

If upper end position d and lower end position e are found in the steps S129 and S130, the decision of step S131 is made. If this decision is negative, the process advances to step S132*a* where the end point having the shorter distance between the near point c is selected. And, the process goes to steps S133*a* and S133*b* which are the main portions of this embodiment.

In step S133*a*, the near point c is determined to be jump stitch data. Subsequently, the process flows to step S133*b* where stitch data is formed between the near point c and the end point selected in the step S132*a* along the center line of the image block.

Figure 20:
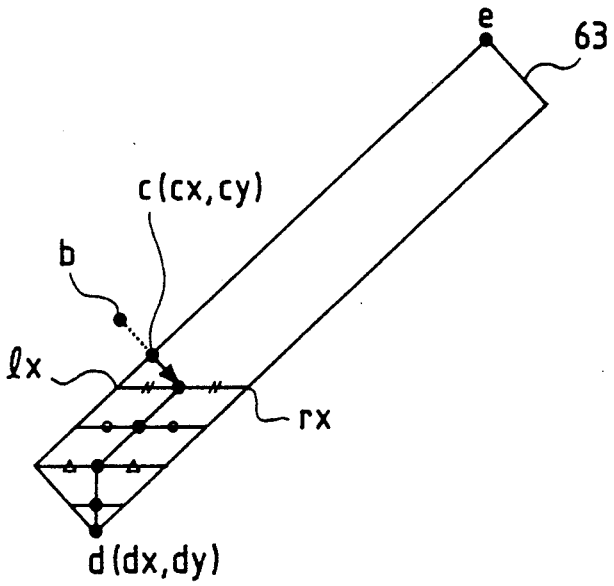
FIG. 20 is an illustration for explaining a specific example of hiddenly sewing a crossover line.

According to the example of FIG. 20, since the distance from the near point c to point d, the lower end of image block 63, is smaller than the distance to point e, the upper end, point d is selected in step S133*b*. And, stitch data to point d is generated in step S133*b*. A specific example of step S133*b* is described later with reference to FIG. 18.

Figure 21:
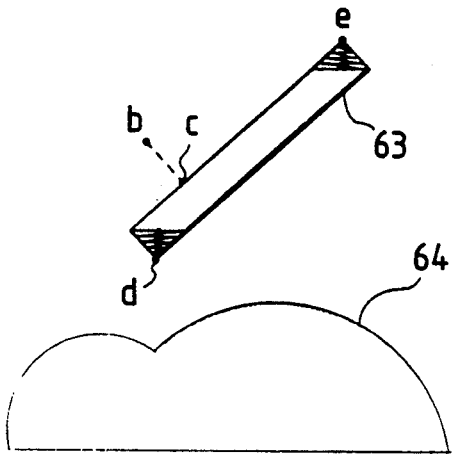
FIG. 21 is an illustration for explaining a method of converting the second original block data located by the search of FIG. 19 to embroidering data.

Then the process goes to step S134 where the embroidering direction is selected. In the case of FIG. 21, the upward direction is selected and stitch data is sequentially produced from d by the steps S146 to S156. If the decision in step S156 is negative conversion to embroidering data of image block 63 to point e, the upper end, has been executed. Execution of this conversion to embroidering data means that the image data of image block 63 has been deleted. Since the operations in steps S146 to S156 are the identical operations in steps S135 to S145, the explanation thereof is omitted.

Figure 22:
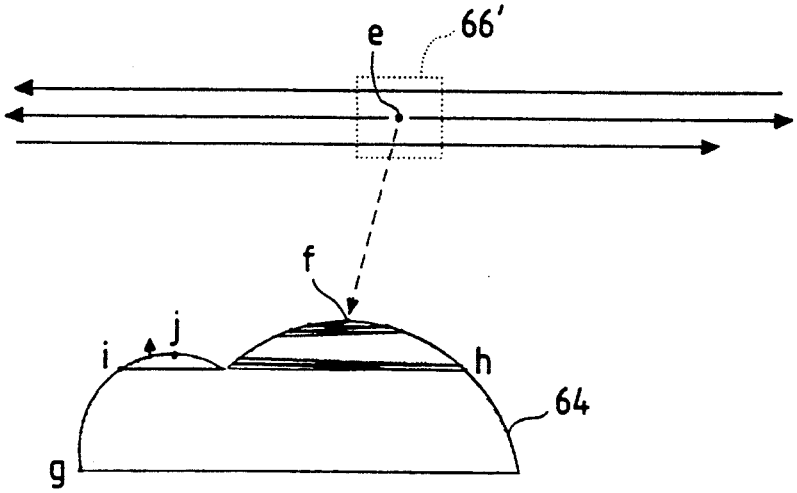
FIGS. 22 and 23 are illustrations for explaining a method of converting the third original image block data to embroidering data.

Then, again returning to step S122, search is performed in rectangular region 66' around point e of FIG. 22 by the processing of this step. If no dot is found in this rectangular region, the process goes to steps S124 and S125 to try to detect a dot. If, for instance, two dots are found by the processings of steps S124 and S125 (step S126 is affirmative), the dot having a shorter distance from point e is selected in step S128. On the other hand, if a dot is found only in either processing of the steps S124 and S125, this dot is selected. Further, if no dot is found, the process advances to step S127 where the termination code of embroidering data is generated.

If a dot is found at point f as shown in FIG. 22, the process goes to steps S129 and S130, where the respective processings are performed with the point f being as the near point. By these processings, the upper end position f and lower end position g of image block 64 of a mountain-like pattern are detected.

Then, the process advances to step S132*a*, the main portion of the present embodiment, where the one having a shorter distance from the point e, namely, point f is selected. Subsequently step S133*a* is entered to generate jump stitch data toward point f. No processing is performed in step S133*b* since the upper point of the image block matches the near point, and the process goes to step S134.

Figure 23:
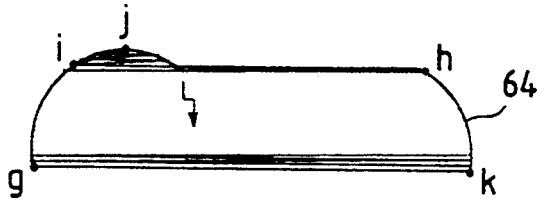

Then, in step S134, determination is made as to whether the embroidering direction is directed downwardly or upwardly, and the downward direction is selected in the case of FIG. 22. If the downward direction is selected, the process goes from step S134 to S135. Since the operations of steps S135 and the subsequent steps have already been described, the explanation thereof is omitted. In addition, jump stitch data from point i to point j of FIG. 22 is generated in step S144, and the generation of stitch data to point k of FIG. 23 is performed by repeating steps S135 to S141 and S145.

As described above, in accordance with this embodiment, since steps S133*a* and S133*b* are newly provided, the crossover yarn between the near point and the upper or lower end of an image block can hiddenly sewed, so that the crossover line can be made unnoticeable. In addition, the crossover yarn formed between pattern blocks becomes shorter and unnoticeable, but it can of course be removed with scissors or the like as needed.

A specific example of the step S133*b* is now described with reference to FIGS. 18 and 20.

First, the distance 1 between the near point c and the lower end d of image block 63 is calculated in step S231. Then, in step S232, it is determined whether the distance 1 is smaller than a reference pitch K (e.g. 3 mm). If this decision is affirmative, the process goes to step S239 where the lower end d is determined to be a needle location point and the operation of hidden sewing is terminated.

If the decision in step S232 is negative, the process goes to step S234 to clear a certain value Py. In step S235, the reference pitch K is added to the value Py. And, in step S236, both ends lx and rx of image block 63 at (Cy+Py)th line are searched. Subsequently the process advances to step S237, where the middle point of the lx and rx, or a coordinate $\{(rx-lx)/2, Cy+Py\}$ is determined to be the first needle location point of the hidden line.

In step S238, it is determined whether or not $\{(Cy+Py)+K\}$ which is the y-coordinate is smaller than the y-coordinate dy of the lower end. If this decision is affirmative, the process returns to step S235 where the operation for seeking the needle location point of the next hidden line is executed. On the other hand, if the decision in step S238 is negative, the process goes to step S239, where the point d is determined to be the needle location point and the process is terminated.

Thus, hidden sewing can be provided between the near point c and the end point of the image block to be next converted to embroidering data. Although the hidden line has been located at the middle point of an image block in this one specific example, it is not limited to this. The hidden line may be formed at a position which is offset of the middle point.

As obvious from the above description, in accordance with the third embodiment, crossover lines are made shorter and automatically hiddenly sewed, so that crossover yarns of embroidery sewing can be made unnoticeable. Also, this allows beautiful embroidery patterns to be sewed.

What is claimed is:

1. An embroidering data production system for reading image data from an original image pattern by means of an image input device, and producing embroidering data from the image data, said embroidering data production system comprising:

an image reader for optically reading the original image pattern and converting it to image data of electrical signals, image data storage means for storing said image data, data processing means for processing said image data, embroidering data conversion means for converting the processed computerized image data to embroidering data, and a RAM card for storing the converted embroidering data;

the embroidering data conversion means including:

an image block detecting section for detecting an image block from said image data, an embroidering data generating section for converting the image data of the image block detected by said image block detecting section to embroidering data;

an end point detecting section which, upon termination of the embroidering data conversion of said image block, seeks upper end data of a next image block detected by said image block detecting section, a distance calculating and selecting section for calculating the distances to said upper and lower end point data from a termination point embroidering data of the image block converted by said embroidering data generating section, and selecting the end point having the longer distance, and a jump stitch data generating section for determining the image data of the end point selected by said distance calculating and selecting section as jump stitch data.

2. An embroidering data production system for reading image data from an original image pattern by means of an image input device, and producing embroidering data from the image data, said embroidering data production system comprising:

an image reader for optically reading the original image pattern and converting it to image data of electrical signals, image data storage means for storing said image data, data processing means for processing said image data, embroidering data conversion means for converting the processed computerized image data to embroidering data, and a RAM card for storing the converted embroidering data;

the embroidering data conversion means including:

an image block detection section for detecting an image block from said image data, an embroidering data generating section for converting the image data of the image block detected by said image block detecting section to embroidering data, an endpoint detecting section which, upon termination of the embroidering data conversion of said image block, seeks upper and lower end data of a next image block detected by said image block detecting section, a compare section for comparing the distance of either the upper or lower end data that is shorter in distance from a termination point embroidering data of the image block converted by said embroidering data generating section with a predetermined reference length, an end point selecting means for selecting the end point having a longer distance if said shorter distance is smaller than said reference length, and the end point having the said shorter distance if said shorter distance is greater than said reference length, and a jump stitch data generating section for determining the image data of the end point selected by said end point selecting means as jump stitch data.

3. An embroidering data production system for reading image data from an original image pattern by means of an image input device, and producing embroidering data from the image data, said embroidering data production system comprising:

an image reader for optically reading the original image pattern and converting it to image data of electrical signals, image data storage means for storing said image data, data processing means for processing said image data, embroidering data conversion means for converting the processed computerized image data to embroidering data, and a RAM card for storing the converted embroidering data;

the embroidering data conversion means including:

an image block detection section for detecting an image block from said image data, an embroidering data generating section for converting the image data of the image block detected by said image block detecting section to embroidering data, a near point detecting section which, upon termination of the embroidering conversion of said image block, seeks the near point of a next image block to be next converted to embroidering data, an end point detecting section for seeking upper and lower ends of said next image block, and a hidden line data generating section for generating stitch data between said near point and either of said upper or lower end that is shorter in distance.

* * * * *